US007770570B2

(12) United States Patent
Lian

(10) Patent No.: US 7,770,570 B2
(45) Date of Patent: Aug. 10, 2010

(54) PAINT BALL GUN WITH ROTATABLE BALL RECEIVING MEMBER

(76) Inventor: Sheng-Jen Lian, P.O. Box 44-2049, Taipei (TW) 10668

( * ) Notice: Subject to any disclaimer, the term of this patent is extended or adjusted under 35 U.S.C. 154(b) by 188 days.

(21) Appl. No.: 12/076,559

(22) Filed: Mar. 20, 2008

(65) Prior Publication Data

US 2009/0235909 A1 Sep. 24, 2009

(51) Int. Cl.
*F41B 11/02* (2006.01)

(52) U.S. Cl. ..... 124/72; 124/71; 124/73; 124/74; 124/77

(58) Field of Classification Search ..... 124/72
See application file for complete search history.

(56) References Cited

U.S. PATENT DOCUMENTS 2,061,341 A * 11/1936 Aigner ..... 124/58
3,802,407 A * 4/1974 Imazu ..... 124/59
7,021,302 B2 * 4/2006 Neumaster et al. ..... 124/48
7,607,424 B2 * 10/2009 Monks ..... 124/77
2003/0005917 A1 * 1/2003 Kim ..... 124/59
2008/0041353 A1 * 2/2008 Gan ..... 124/63
2008/0236558 A1 * 10/2008 Bosch et al. ..... 124/48
2008/0257327 A1 * 10/2008 Monks ..... 124/48
2008/0308085 A1 * 12/2008 Polk, III ..... 124/1
2009/0235911 A1 * 9/2009 Klarborg ..... 124/66

* cited by examiner

*Primary Examiner*—Troy Chambers
*Assistant Examiner*—Samir Abdosh

(57) ABSTRACT

A paint ball gun includes a ball receiving member rotatably received in the top tube of the paint ball gun and the ball receiving member includes a space defined therein which communicates with a receiving hole so that paint balls drop into the space via the receiving hole. The ball receiving member is connected with a rotary unit which is controlled by operation of the trigger powered by a power unit which introduces pressurized air to activate the rotary unit which rotates the ball receiving member. The receiving hole communicates with a hopper to receive a paint ball and pressurized air cannot enter into the ball receiving member when the ball receiving member is in the first position. The receiving hole is sealed and pressurized air enters into the ball receiving member to shoot the paint ball when the ball receiving member is in the second position.

6 Claims, 6 Drawing Sheets

PAINT BALL GUN WITH ROTATABLE BALL RECEIVING MEMBER

BACKGROUND OF THE INVENTION (1) Field of the Invention

The present invention relates to a paint ball gun with a rotatable ball receiving member which receives a paint ball one at and time and driven by pressurized air after firing so as to reduce the amount of pressurized air required.

(2) Description of the Prior Art

A conventional paint ball gun generally includes a rod which is moved longitudinally in the barrel and the rod is connected with a ball receiving member in which the pressurized air is introduced to fire the paint ball received in the ball receiving member. The paint ball generates a reaction force when firing and the reaction force pushes the ball receiving member and the rod backward. The rod is stopped by the trigger unit so as to form a ready-to-shoot status. The travel distance of the rod and the ball receiving member has to be long enough so as to store sufficient force to activate a valve which is cooperated with the trigger unit to dispense pressurized air into the paint ball gun. However, the long travel distance makes the paint ball gun to be bulky and heavy. The number of the parts in the paint ball gun contributes a complicate mechanism. The long travel distance of the movement of the rod and the ball receiving member also generates high wearing and noise and needs more pressurized air which is limited and expensive.

The present invention intends to provide a paint ball gun which uses a rotatable ball receiving member which does not travel a long distance and only small amount of pressurized air is needed.

SUMMARY OF THE INVENTION

The present invention relates to a paint ball gun that comprises a top tube having a barrel connected to an end thereof and a tubular portion of a hopper is connected to a top of the top tube. A ball receiving member is rotatably received in the top tube and includes a space defined therein for receiving a paint ball. The ball receiving member is connected to a rotary unit which rotates the ball receiving member. A receiving hole is defined through a wall of the ball receiving member and removably communicates with the tubular portion of the hopper, an inlet defined through the wall of the ball receiving member and located at an angular position that is different from that of the receiving hole. A power unit provides power to activate the rotary unit so as to rotate the ball receiving member between a first position and a second position. The receiving hole communicates with the tubular portion of the hopper and the inlet is sealed when the ball receiving member is in the first position. The receiving hole is sealed and the inlet is opened to introduce pressurized air in the ball receiving member when the ball receiving member is in the second position.

The primary object of the present invention is to provide a paint ball gun wherein the paint balls drop into the gun and received by a rotatable ball receiving member which does not moved longitudinally so that the pressurized air required to drive the ball receiving member is much less than the conventional paint ball guns.

Another object of the present invention is to provide a paint ball gun wherein the paint balls drop into the gun and received by a rotatable ball receiving member which does not moved longitudinally so that the pressurized air required to drive the ball receiving member is much less than the conventional paint ball guns.

Yet another object of the present invention is to provide a paint ball gun wherein the ball receiving member can quickly rotated between two positions so as to reduce the time gap between consecutive shoots.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
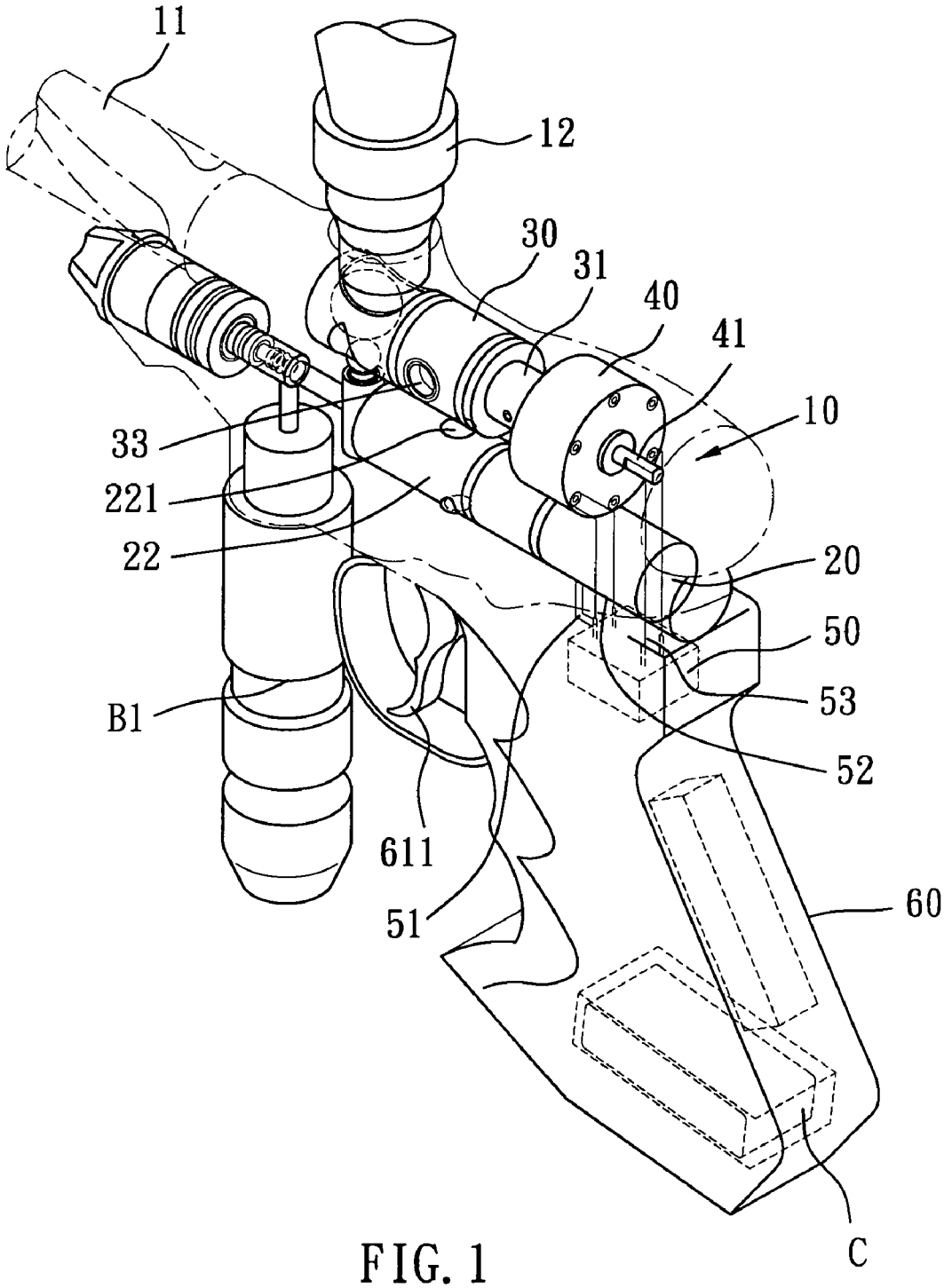
FIG. 1 is a perspective view of the paint ball gun of the present invention.
Figure 2:
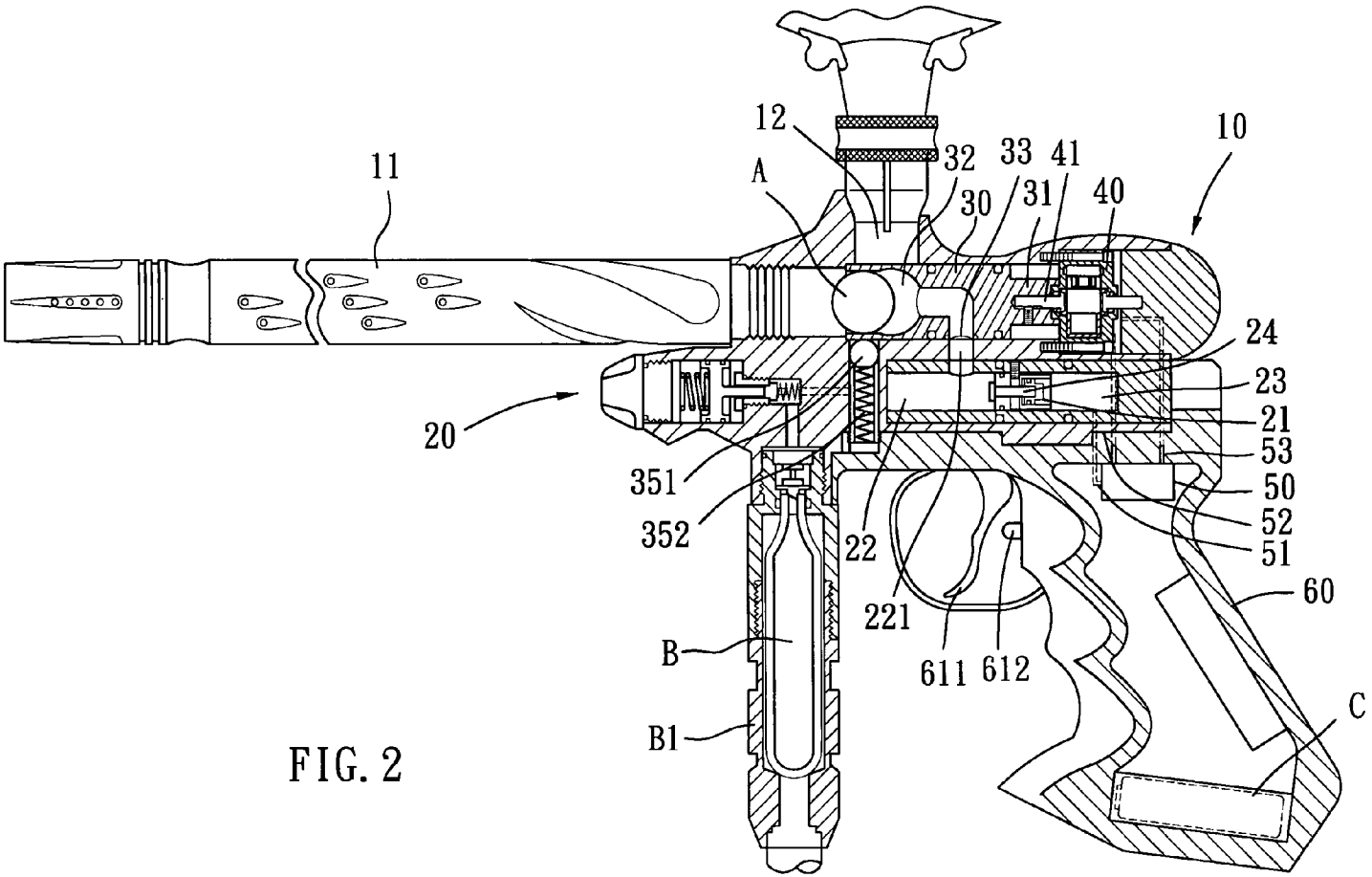
FIG. 2 is a cross sectional view of the paint ball gun of the present invention.
Figure 3:
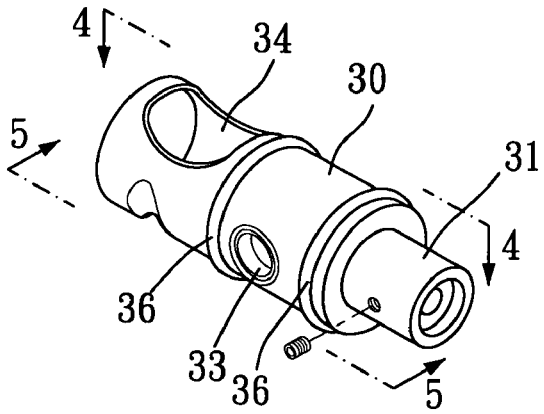
FIG. 3 shows the ball receiving member of the paint ball gun of the present invention.
Figure 4:
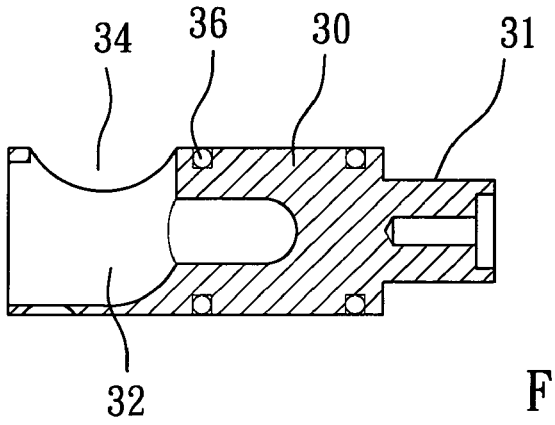
FIG. 4 shows the cross sectional view, taken along line 4-4 in FIG. 3, of the ball receiving member in the first position.
Figure 5:
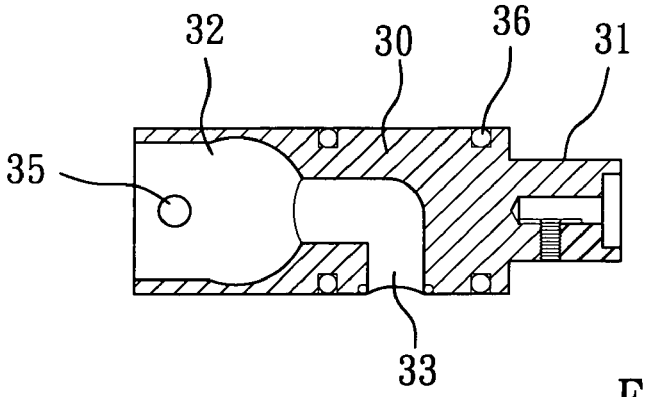
FIG. 5 shows the cross sectional view, taken along line 5-5 in FIG. 3, of the ball receiving member in the second position.

Referring to FIGS. 1 and 2, the paint ball gun of the present invention comprises a top tube 10 having a barrel 11 connected to an end thereof and a tubular portion 12 of a hopper "D" is connected to a top of the top tube 10. A ball receiving member 30 is rotatably received in the top tube 10 so that paint balls drop from the tubular portion of the hopper "D" into the top tube 10 via a hole in the top tube 10. The ball receiving member 30 as shown in FIGS. 3 to 5 includes a space 32 defined therein and a front open end which communicates with the space 32. A connection end 31 extends from a rear end of the receiving member 30 so as to be connected with a rotary unit 40. A receiving hole 34 is defined through a wall of the ball receiving member 30 and removably communicates with the tubular portion 12 of the hopper "D". An inlet 33 is defined through the wall of the ball receiving member 30 and located at an angular position that is different from that of the receiving hole 34. Seals 36 are mounted to the outside of the ball receiving member 30 and in contact with the inner periphery of the top tube 10 so as to prevent leakage. A through hole 35 (FIG. 5) is defined through the wall of the ball receiving member 30 and communicates with the space 32.

The rotary unit 40 is received in the top tube 10 and has a driving axle 41 extending from two ends of the rotary unit 40, one end of the driving axle 41 is connected to the connection end 31 of the ball receiving member 30.

A chamber tube 20 is located beneath the top tube 10 and includes a first valve 21 received therein. The first valve 21 divides an interior of the chamber tube 20 to be a front chamber 22 and a rear chamber 23. A communication hole 221 is defined through the chamber tube 20 and in communication between the front chamber 22 and the inlet 33. A communication tube 24 extends through the first valve 21 so as to introduce air from the front chamber 22 to the rear chamber 23 when shooting.

A handle 60 is connected to the chamber tube 20 and a power unit is connected to the handle 60. The power unit is a second valve 50 which provides power to the rotary unit 40 and can be powered by hydraulic power or electric power from the power source "C" in the inner end of the handle 60. The rear chamber 23 includes a communication pipe 51 which is connected with the power unit and includes a first guide tube 52 and a second guide tube 53, the first guide tube 52 communicates with the first passage 42 and the second guide tube 53 communicates with the second passage 43.

The chamber tube 20 includes a recess which is located corresponding to the receiving hole 34 of the ball receiving member 30, a bead 351 and a spring 352 are received in the recess. The bead 351 is biased by the spring 352 toward the through hole 35 defined through the wall of the ball receiving member 30. A diameter of the through hole 35 is smaller than a diameter of a paint ball "A" so that the paint ball "A" does not drop into the through hole 35 and the bead 351 can contact against and position the paint ball "A". The paint ball gun equipped with a pressurized air bottle "B" which is enclosed by a case "B1" and is connected to the chamber tube 20 so as to provide pressurized air to the front chamber 22.

Figure 6:
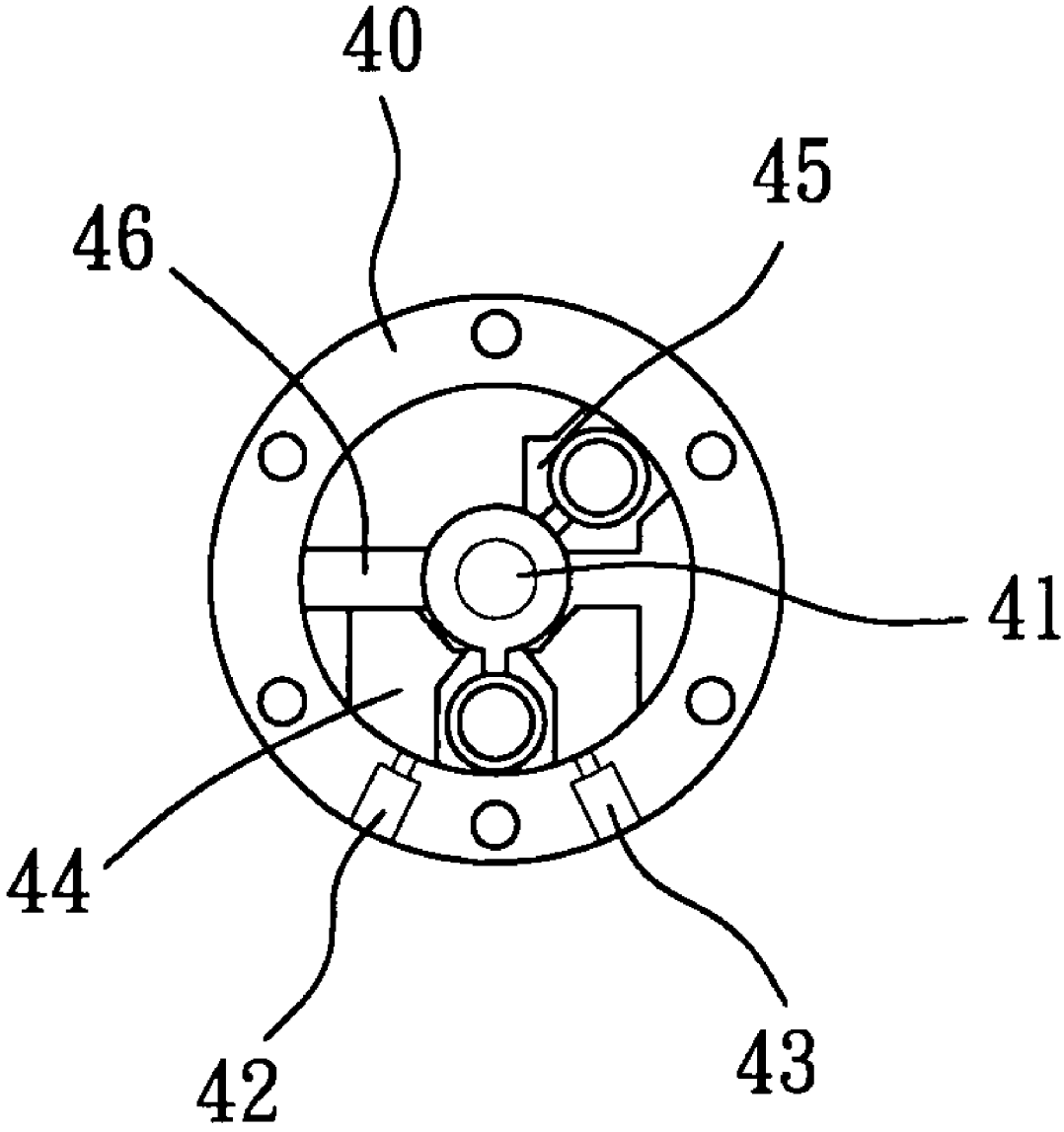
FIG. 6 is an end view of the second valve of the paint ball gun of the present invention.

As shown in FIG. 6, the rotary unit 40 includes a first passage 42 and a second passages 53 defined radially through a wall thereof. A first plate 44 and a second plate 45 are connected radially to the driving axle 41 in the rotary unit 40. A blade 46 is fixed to the driving axle 41 and located between the first and second plates 44, 45. The blade 46 moves 90 degrees of angular distance between the first plate 44 to the second plate 45. When the pressurized air is introduced into the rotary unit 40 via the first passage 42, the blade 46 moves clockwise toward the second plate 45. When the pressurized air is introduced into the rotary unit 40 via the second passage 43, the blade 46 moves counter clockwise toward the first plate 44.

Figure 7:
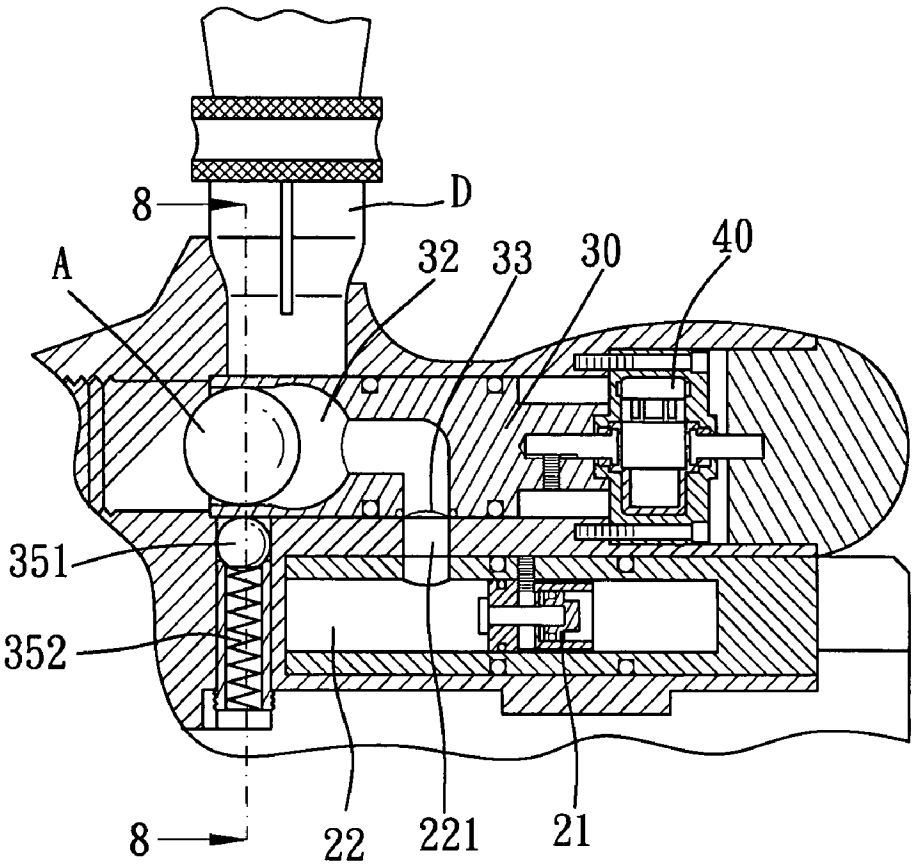
FIG. 7 is a cross sectional view to show the ball receiving member is the second position and the receiving hole is moved away from the hopper and the inlet communicates with the front chamber.
Figure 8:
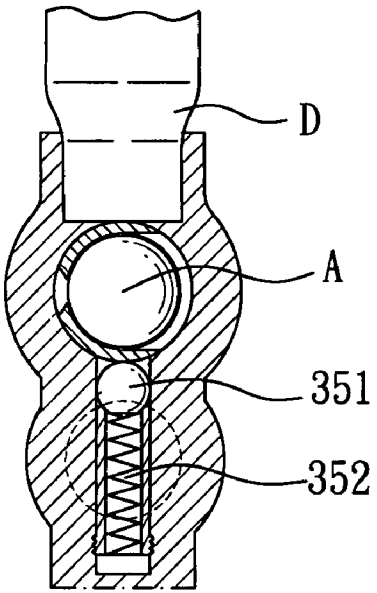
FIG. 8 is a cross sectional view taken along line 8-8 in FIG. 7.
Figure 9:
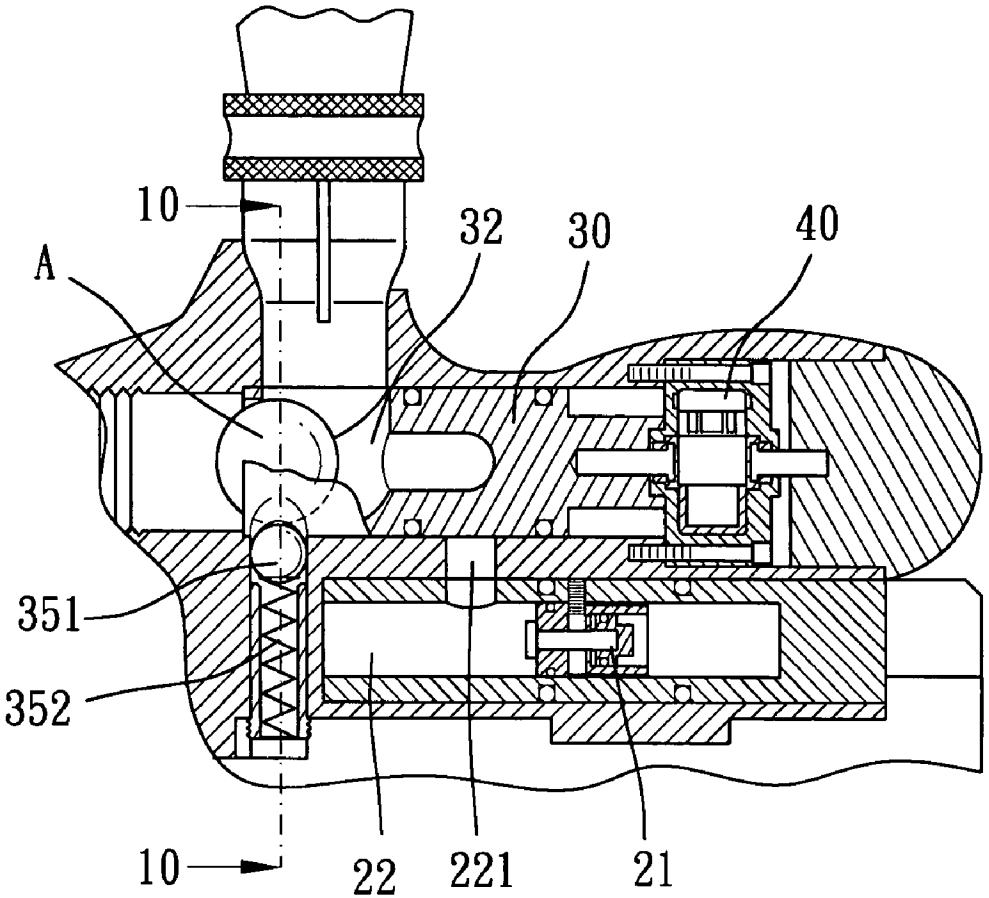
FIG. 9 is a cross sectional view to show the ball receiving member is the first position and the receiving hole is in communication with the hopper and the inlet is sealed from the front chamber.
Figure 10:
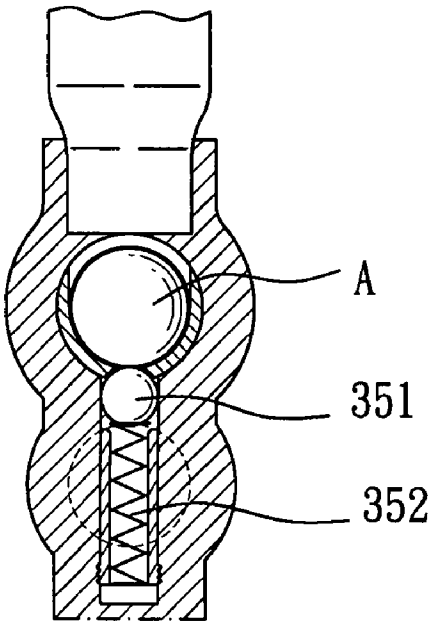
FIG. 10 is a cross sectional view taken along line 10-10 in FIG. 9.

When the ball receiving member 30 is in its first position as shown in FIGS. 9 and 10, the paint ball "A" drops into the top tube 10 via the tubular portion 12 of the hopper "D" and enters the space 32 of the ball receiving member 30 via the receiving hole 34. The communication hole 221 and the inlet 33 are no in communication with each other. The paint ball "A" is pushed against by the bead 351. When the user pulls the trigger 611 which pushes the switch 612 located behind the trigger 611, the second valve 50 is activated, pressurized air in the front chamber 22 enters the rear chamber 23 and is introduced into the rotary unit 40 which is then rotated because the blade 46 is pushed by the pressurized air. The rotation of the rotary unit 40 rotates the ball receiving member 30 to the second position as shown in FIGS. 7 and 8. The receiving hole 34 moves away from the tubular portion 12 of the hopper "D" and the inlet 33 is opened to the communication hole 221 so that pressurized air in the front chamber 22 enters the space 32 to shoot the paint ball "A" via the barrel 11.

By introducing pressurized air into the rotary unit 40 from the first and second passages 42, 43, the ball receiving member 30 is rotated within 90 degrees between the first and second positions, and this requires only a small amount of pressurized air. The ball receiving member 30 does not move longitudinally so that the paint ball gun can be made to be compact.

While we have shown and described the embodiment in accordance with the present invention, it should be clear to those skilled in the art that further embodiments may be made without departing from the scope of the present invention.

What is claimed is:

1. A paint ball gun comprising:

a top tube having a barrel connected to an end thereof and a tubular portion of a hopper connected to a top of the top tube, a ball receiving member rotatably received in the top tube and including a space defined therein, the ball receiving member including a front open end which communicates with the space and a connection end extending from a rear end of the receiving member, a receiving hole defined through a wall of the ball receiving member and removably communicating with the tubular portion of the hopper, an inlet defined through the wall of the ball receiving member and located at an angular position that is different from that of the receiving hole;

a rotary unit received in the top tube and having a driving axle extending therefrom which is connected to the connection end of the ball receiving member;

a power unit providing power to the rotary unit so as to rotate the ball receiving member between a first position and a second position, the receiving hole communicating with the tubular portion of the hopper and the inlet being sealed when the ball receiving member is in the first position, the receiving hole being sealed and the inlet being opened when the ball receiving member is in the second position;

wherein the rotary unit includes a first passage and a second passages defined radially through a wall thereof, a first plate and a second plate are connected radially to a driving axle in the rotary unit, a blade is fixed to the driving axle and located between the first and second plates, the blade moves 90 degrees of angular distance between the first plate to the second plate.

2. The paint ball gun as claimed in claim 1, wherein a chamber tube is located beneath the top tube and includes a first valve received therein, the first valve divides an interior of the chamber tube to be a front chamber and a rear chamber, a communication hole is defined through the chamber tube and in communication between the front chamber and the inlet, a communication tube extends through the first valve so as to introduce air from the front chamber to the rear chamber, the rear chamber includes a communication pipe which is connected with the power unit which is a second valve and includes a first guide tube and a second guide tube, the first guide tube communicates with the first passage and the second guide tube communicates with the second passage.

3. The paint ball gun as claimed in claim 2, wherein the chamber tube includes a recess which is located corresponding to the receiving hole of the ball receiving member, a bead and a spring are received in the recess, the bead is biased by the spring toward a through hole defined through the wall of the ball receiving member.

4. The paint ball gun as claimed in claim 3, wherein a diameter of the through hole is smaller than a diameter of a paint ball.

5. The paint ball gun as claimed in claim 1, wherein the rotary unit is driven by hydraulic power.

6. The paint ball gun as claimed in claim 1, wherein the rotary unit is driven by electric power.

* * * * *